US005354949A

United States Patent [19]

Zwaan

[11] Patent Number: 5,354,949

[45] Date of Patent: Oct. 11, 1994

[54] PICK-UP ELEMENT IN A STRINGED INSTRUMENT

[76] Inventor: Erno Zwaan, Henrick de Keijsersplein 6 III, 1073 SX Amsterdam, Netherlands

[21] Appl. No.: 978,354

[22] Filed: Nov. 18, 1992

[30] Foreign Application Priority Data

Nov. 18, 1991 [NL] Netherlands ..... 9101916

[51] Int. Cl.[5] ..... G10H 3/18

[52] U.S. Cl. ..... 84/727

[58] Field of Search ..... 84/726–728

[56] References Cited

U.S. PATENT DOCUMENTS 3,715,446 2/1973 Kosinski ..... 84/727
4,283,982 8/1981 Armstrong .
4,581,974 8/1986 Fender .

FOREIGN PATENT DOCUMENTS 8204156 11/1982 World Int. Prop. O. .

*Primary Examiner*—Stanley J. Witkowski
*Attorney, Agent, or Firm*—Sandler, Greenblum & Bernstein

[57] ABSTRACT

A pick-up element for a stringed instrument includes a pick-up section underneath each string. Each pick-up section includes at least three magnetic poles, with the magnetic poles being positioned in a row underneath the respective string. At least one of the poles of each pick-up section includes a first bolt which can be moved toward and away from the string. The magnetic poles derive their magnetic action from permanent magnets positioned between the poles. The permanent magnets are magnetically separated from the bolt not situated on the outside of the pick-up section. At least the bolt not situated on the outside of the pick-up section is capable of being screwed into the pick-up element at least far enough so that the top end of the bolt is located flush with the side faces of the permanent magnets which are closest to the strings.

11 Claims, 2 Drawing Sheets

PICK-UP ELEMENT IN A STRINGED INSTRUMENT

BACKGROUND OF THE INVENTION

The invention relates to a pick-up element in a stringed instrument for converting a vibration generated in at least one string into an electrical signal, comprising a pick-up section underneath each string, which pick-up section comprises at least three magnetic poles, each magnetic pole exerting a magnetic force on the string, the magnetic poles being placed in a row underneath the string, at least one of the poles comprising a first bolt which can be moved in the direction of the string and the magnetic poles deriving their magnetic action from permanent magnets positioned between the poles.

Such a pick-up element is disclosed by WO 82/04156. The latter describes a pick-up element for an electric guitar which comprises, for each string, a section which converts the mechanical vibrations of the string into an electrical signal. The electrical signal is combined with the signals from the other strings and, after amplification in an electrical amplifier, is fed to a loudspeaker. The mechanical vibration is converted into an electrical signal by means of magnetic coupling between the string and the poles of permanent magnets incorporated in the pick-up element. A coil wound round the permanent magnets converts the varying magnetic field due to the string vibrating in the vicinity of the magnets into an electrical voltage which mirrors the vibration. One of the poles comprises a magnetisable bolt which can be moved in the direction of the string and which is in magnetic contact with the permanent magnets. In this way, the intensity of the magnetic coupling and, therefore, the amplitude of the electrical signal generated can be regulated for each string by rotating the bolt in the pick-up element.

A disadvantage of the known pick-up element is that, once it has been mounted in a fixed position underneath the strings, only the intensity of the magnetic coupling for each string can be regulated. Regardless of the position of the bolt in the pick-up element, which bolt can be moved only by a small amount, the frequency spectrum pick-up is virtually the same. The timbre pick-up for each string consequently remains the same. The frequency spectrum picked up can be altered only by displacing the entire element in the longitudinal direction of the string. Thus, an element placed underneath the centre of the strings will give a much "richer" sound than one placed underneath the ends of the strings. Displacement of the entire element underneath the strings is, however, impractical. In practice, the timbre is therefore adjusted by means of high-pass and low-pass filters in the electrical amplifier. The timbre, however, can no longer be adjusted for each individual string by these means.

SUMMARY OF THE INVENTION

The object of the invention is to provide a pick-up element for stringed instruments allowing not only the adjustment of the intensity of the magnetic coupling for each string but also of the frequency spectrum coupled for each string and, consequently, the timbre.

This object is achieved, according to the invention, by a pick-up element wherein the permanent magnets are separated from the pole (poles) not situated at the outside of the pick-up section by nonmagnetic means.

The measures according to the invention considerably extend the possibilities of altering the timbre because the coupled frequency spectrum and the intensity thereof can be adjusted for each string in a very simple, mechanical way. Therefore, a simple pickup element is provided, with which the entire timbre of the stringed instrument may be easily adjusted to several different rooms and to the personal taste without using additional electronic correction. No longer one has to put up with the fixed tuning of the pick-up element by the manufacturer.

In a first preferred embodiment, at least one second pole of each pick-up section of the pick-up element comprises a second bolt which can be moved in the direction of the string. In this embodiment, the portion of the string whose vibrations are detected can be moved partially along the string. The timbre can thereby be regulated to an even larger extent for each string.

In a second preferred embodiment, each pick-up section of the pick-up element comprises three poles which each comprise a bolt. The timbre can thereby be regulated still more strongly between a "rich" and a "thin" sound. In addition, this allows the volume of the signals picked up from mutually adjacent strings to remain substantially constant, whereas the frequency spectrum can nevertheless be adjusted for each string. This is not possible in existing pick-up elements. This is achieved by purely mechanical means, namely by means of the adjustment of some bolt-type magnetic poles. This makes the pick-up element according to the invention simple and inexpensive.

In a third preferred embodiment, the magnets of the pick-up element are RES ("rare earth sintered") magnets. With such magnets, which are much more powerful than ferrite magnets, the pick-up element can be made so small that it is no larger than the dimensions of a standard pick-up element for electric guitars.

In a fourth preferred embodiment, the poles of the pick-up element which do not comprise bolts are made of Stanley-knife material. This material is found to have suprisingly good magnetic properties and to be able to contribute further to the restricted dimensions of the pick-up element according to the invention.

BRIEF DESCRIPTION OF THE DRAWINGS

The invention will be explained in greater detail below by reference to the drawings.

In the drawings.

DETAILED DESCRIPTION OF THE EMBODIMENTS

Figure 1:
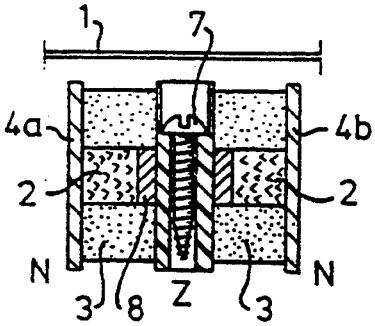
PRIOR ART Fig-1
FIG. 1 shows a diagrammatic representation of a section of a known pick-up element.

FIG. 1 shows a section of a known pick-up element which is located underneath a string 1 of, for example, an electric guitar. The pick-up element may, however, be used in any other arbitrarily chosen stringed instrument whose mechanical string vibration has to be converted into a corresponding electrical signal. Underneath each string of a stringed instrument there is an individual section. The sections are placed together in a housing (which is not shown). The known pick-up element comprises permanent magnets 2 which have a coil 3 wound around them. The magnets 2 are placed in such a way that they face one another by means of the same pole (north or south) and the outwardly directed poles also have the same polarity. FIG. 1 shows the situation where the south poles Z face one mother and the north poles N are situated at the outsides of the pick-up element. The two outwardly directed poles comprise pole faces 4*a*, 4*b* which are made of magnetisable material. The inwardly situated (south) poles are separated from one another by a hollow space containing the screw thread portion of a bolt 7. The bolt 7 is also made of a magnetisable material. The construction is such that the bolt 7 is in direct magnetic contact with the inwardly situated (south) poles of the magnets 2. For this purpose, for example, magnetisable plates 8 are provided which are in magnetic contact both with the bolt 7 and with the magnets 2.

In the known pick-up element of FIG. 1, the bolt 7 can be moved in the direction of the string 1. Both the bolt 7 and the poles 4*a*,4*b* exert a magnetic force on the string. In the known device, the magnetic force exerted by the bolt 7 on the string 1 is much greater than the forces exerted by the poles 4*a*, 4*b*. Because the bolt 7 can be moved only to a small extent in the pick-up element, this is still true if the bolt 7 is located in the lowest position in the pick-up element. This means that the pick-up element detects virtually only the vibrations of the string 1 above the bolt 7. For known pick-up elements it is the case that approximately 80% of the magnetic coupling with the string takes place by means of the bolt 7 and each of the poles 4*a*, 4*b* provides 10% of the magnetic coupling with the string 1. The displacement of the bolt 7 therefore only has the consequence that the intensity of the magnetic coupling between the bolt 7 and the string 1 alters. Altering the position of the bolt 7 therefore only alters the intensity of the signal picked up.

If an alteration of the timbre is desired, the known element has to be moved in a direction parallel to the direction of the string 1. If the pick-up element is placed under the centre of the string 1, the sound picked up and reproduced by means of an amplifier will sound "richer", i.e. it then contains more lower frequencies. If, on the other hand, the pick-up element is placed underneath the end of the string, for example above the bridge of an electric guitar, the sound picked up will sound "thinner". In that case, the spectrum picked up contains more high tones. In practice, however, the displacement of the element along a stringed instrument is very impractical. The only alternative with the existing pick-up element is formed by the alteration of the cut-off frequencies of the high-pass and low-pass filters of the electrical amplifier which amplifies the signal picked up by the pick-up element and reproduces it by means of a loudspeaker. A disadvantage of this, however, is that it is not the timbre for each string which can be adjusted, but only the timbre of the sound picked up from all the strings together.

Figure 2A:
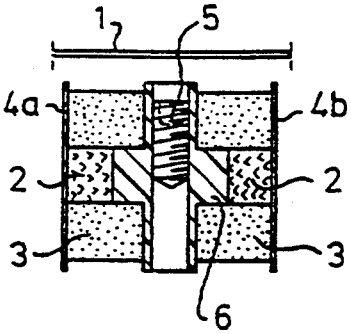
FIGS. 2*a* to 4 inclusive show a cross section of a section of pick-up elements according to the invention.
Figure 2B:
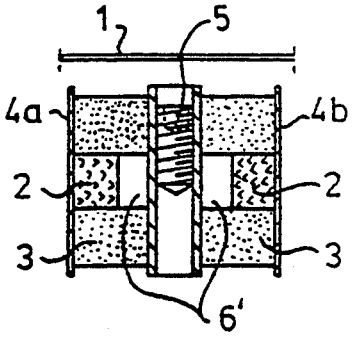

FIGS. 2*a* and 2*b* show a first embodiment of a pick-up element in accordance with the present invention. In these figures, as in FIGS. 3 and 4, the same numerals refer to the same components as in FIG. 1. There are two great differences from the pick-up element according to FIG. 1. Firstly, the bolt 5 is separated from the permanent magnets 2 by means of nonmagnetisable separating elements 6 (FIG. 2*a*), so that the bolt no longer makes direct magnetic contact with the permanent magnets 2. This achieves the result that the magnetic forces exerted by the poles 4*a* end 4*b* on string 1 are no longer very small with respect to the magnetic force exerted by the bolt 5 on the string 1. Consequently, the pick-up element no longer picks up virtually only the frequency pattern of the vibration of the string 1 directly above the bolt 5, but also the frequency pattern of the vibrations of the string 1 above the poles 4*a* and 4*b*. Expressed in percentages, the bolt 5 provides, for examples, 50% of the magnetic coupling with the string 1, while each of the poles 4*a*, 4*b* then contribute 25% thereof. These percentages are only examples; other percentages are possible without departing from the scope of the invention. The only important point is that the bolt 5 is located at a distance from the magnets 2, as a result of which the magnetic coupling between the bolt 5 and the string contributes significantly less than 80% of the total magnetic coupling. In the embodiment according to FIG. 2*a* (and according to FIGS. 3 and 4), the bolt 5 (5*a*) is separated from the magnets 2 by nonmagnetisable separating elements 6. These also provide support for the coils 3 partly wound around them. The space between the magnets 2 and the bolt 5 (5*a*) may, however, also be empty if this support for the coils 3 is unnecessary. The space, indicated by 6' in FIG. 2*b*, is therefore not then filled with nonmagnetisable material. Such hollow cavities 6' can also be used in the embodiments according to FIGS. 3 and 4 (not shown therein).

Figure 5:
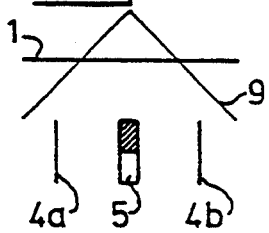
FIGS. 5 to 9 show a symbolic representation of the operation of a pick-up element according to the invention.

Secondly, the bolt 5 can be moved more deeply into the pickup element. FIG. 5 diagrammatically shows the state in which the bolt 5 is in the uppermost position, as close as possible to the string 1. In that case, the magnetic coupling to the string 1 takes place most strongly via the bolt 5. This is shown symbolically by the triangle 9 in FIG. 5, which symbolises the fact that the magnetic force of the bolt 5 on the string 1 is greater than that of the poles 4*a* and 4*b*. If the bolt is screwed more deeply into the pick-up element, however, the magnetic force of the bolt 5 on the string 1 is appreciably attenuated and the ratio of the force at bolt 5 with respect to the forces exerted by the poles 4*a* and 4*b* will follow the pattern shown by means of the triangle 9 in FIG. 6. In order to obtain the effect of FIG. 6, the top of the bolt 5 should be capable of being screwed into the pick-up element at least down to the face of the permanent magnets 2 which is nearest the string 1. In practice, this means that the bolt 5 can be screwed approximately 6 mm into the pick-up element. In a preferred embodiment, the bolt 5 is a socket-head bolt.

Figure 6:
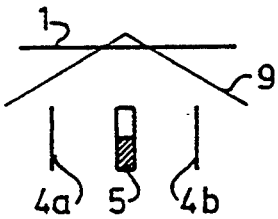

In the situation of FIG. 6, the pick-up element will pick up more vibrations from the string at the points above the poles 4*a* and 4*b* than in the situation of FIG. 5. Rotating the bolt 5 therefore alters the frequency spectrum of the vibrations picked up and, consequently, the timbre of the sound formed via an amplifier and a loudspeaker. In earlier pick-up elements, the magnetic force of the poles 4*a* and 4*b* with respect to that of the bolt 5 was so low because the bolt 5 was in direct magnetic contact with the permanent magnets 2 so that displacing the bolt in the known device altered virtually only the intensity of the vibrations picked up but not the frequency spectrum. As a result of the fact that the bolts has been made less strongly magnetic with respect to the poles 4*a* and 4*b* and the bolt can be screwed mope deeply into the pick-up element, the effect of FIGS. 5 and 6 can be achieved.

In a preferred embodiment, the magnets 2 are composed of RES (rare earth sintered) material with which handy, small and nevertheless very strong magnets can be made. In a further preferred embodiment, the poles 4*a* and 4*b* are composed of Stanley-knife material which is in magnetic contact with the permanent magnets 2. As a result of these measures, a pick-up element can be made which achieves the desired effect and which has the standard dimensions of a pick-up element for electric guitars.

Figure 3:
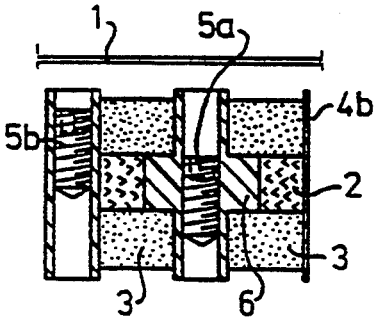
Figure 4:
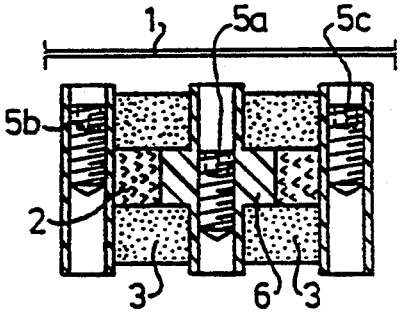
Figure 7:
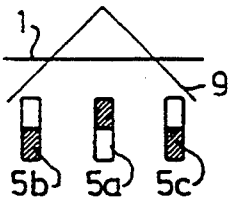
Figure 8:
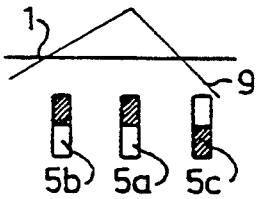
Figure 9:
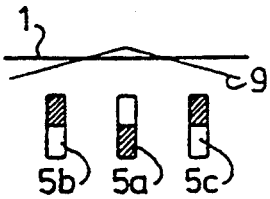

FIG. 3 shows a further embodiment of a pick-up element according to the invention. In the latter, the pole 4*a* of the pick-up element according to FIG. 2 has been replaced by a second bolt 5*b*. In FIG. 4, the pole 4b has also been replaced by a bolt 5*c*. By displacing the two bolts in FIG. 3 and the three bolts in FIG. 4 with respect to one another, the region where the strongest magnetic coupling with the string i takes place can be displaced in the longitudinal direction of the string 1. The intensity of the coupling can also be adjusted. All these features are shown in FIGS. 7 to 9 inclusive for the situation of the pick-up element having three bolts 5*a*, 5*b* and 5*c*. The triangle 9 again shows symbolically how powerful the magnetic coupling of the bolts with the string 1 is. It is thereby possible to adjust for each string how "rich" oF "thin" the sound picked up is because the frequency spectrum picked up depends on the depth position of the three bolts 5*a*, 5*b* and 5*c*. Altering the precise position of the magnetic coupling as shown for the situation with three bolts in FIGS. 7 to 9 inclusive, can also be done with the aid of two movable bolts, that is to say with the device of FIG. 3 which, as regards possibilities, is situated between the situation of FIGS. 2 and 4. In theory, more than three bolts can also be placed in a row beneath a string 1. Equally, two or more of the pick-up elements shown in FIGS. 2, 3 or 4 can be placed one behind the other underneath a string 1.

Figure 10:
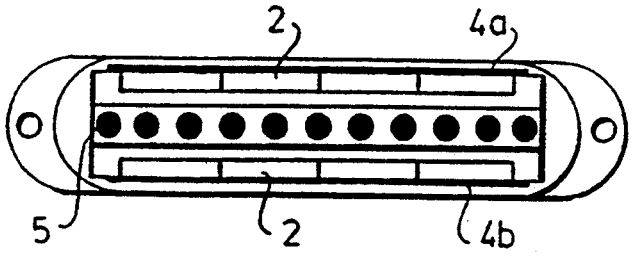
FIGS. 10 and 11 show diagrammatical plan views of a pick-up element according to the invention.
Figure 11:
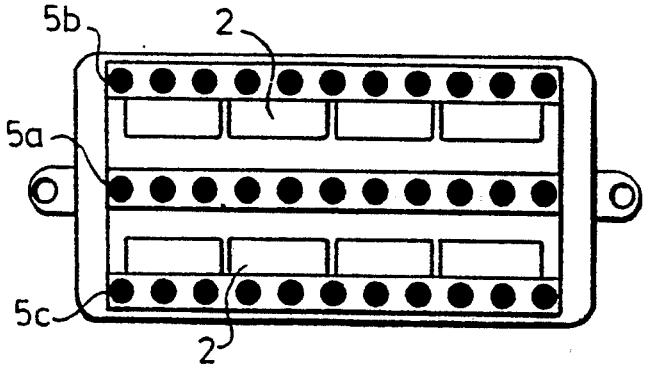

It is also unnecessary for magnetic poles 5*a*, 5*b*, 5*c* to be located precisely right underneath each string 1; for example, eleven rows of magnetic poles 5*a*, 5*b*, 5*c* adjacent to one another in a pick-up element can be used. This increases the possible applications because such a pick-up element can be displaced in a suitable manner in the longitudinal direction of the strings (which are usually not exactly parallel) while the exact number of strings, for example four or six, is therefore less important. This situation is shown in FIGS. 10 and 11, in which the reference numerals in FIG. 10 and 11 respectively are the same as in FIG. 2*a* and 4, respectively. FIG. 11 shows that the outermost rows of bolts 5*b*, 5*c* are placed as far as possible at the outer edge of a pick-up element in order to make the effect as great as possible; the further the bolts 5*b*, 5*c* are removed from the bolts 5*a*, the stronger the difference in the frequency spectrum picked up. However, the dimensions of the pick-up elements of FIGS. 10 and 11 are preferably standard, thereby enlarging, the interchangeability with existing pick-up elements.

Figure 12A:
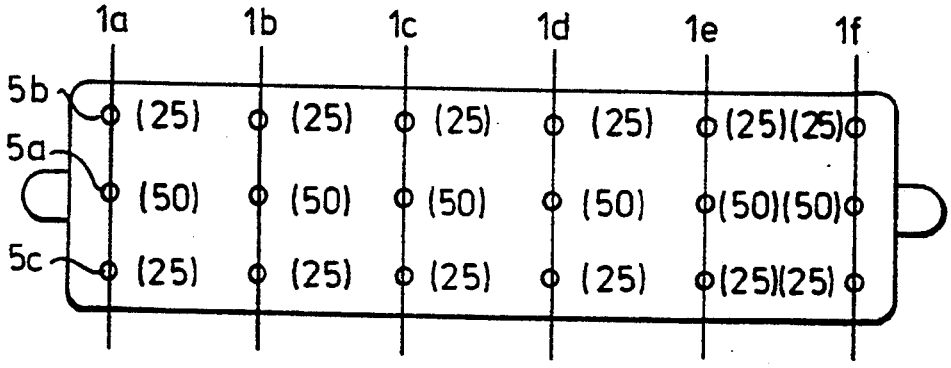
FIGS. 12*a* and 12*b* show a diagrammatic illustration of an adjustment of the pick-up element according to the invention.
Figure 12B:
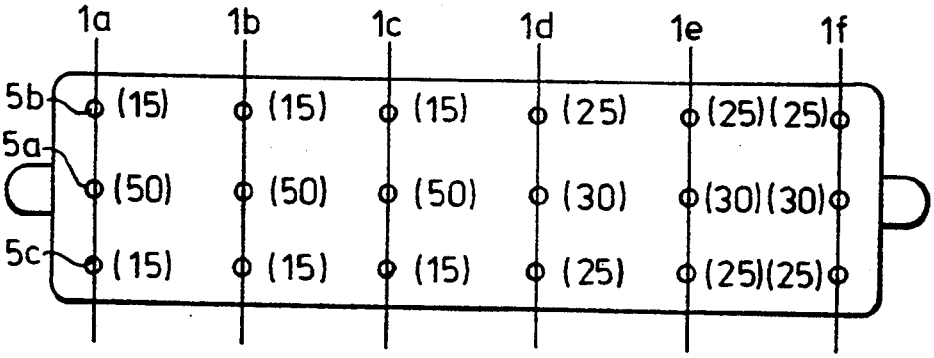

In the case of existing pick-up elements, a problem for, for example, electric guitars is that a marked difference can be heared between the sound of the wrapped (thick) strings and the unwrapped (thin) strings. The wrapped strings often sound too "rich" and the unwrapped strings often sound too "thin". This problem can be solved with the pick-up element according to the invention. FIG. 12*a* diagrammatically shows a plan view of a pick-up element having six rows of three bolts 5*a*, 5*b*, 5*c* with strings 1*a* to if inclusive above them. Shown in brackets next to each bolt 5*a*, 5*b*, 5*c* is the extent to which the bolt concerned is magnetically coupled with the string situated above it as a percentage of the total magnetic coupling for each string. In the situation shown in FIG. 12*a*, the problems indicated above may arise. By now adjusting the bolts 5*a*, 5*b*, 5*c* as in FIG. 12*b* the too "rich" or "thin" sound can be corrected for each string. FIG. 12*a* shows in brackets next to each bolt 5*a*, 5*b*, 5*c* the extent to which the bolt concerned is magnetically coupled, as a percentage of the total magnetic coupling for each string, as pertains to FIG. 12*a*. Where the same figures as in FIG. 12*a* are next to the bolts, the respective bolt adjustment is therefore unaltered with respect to that of FIG. 12*a*. If a total magnetic coupling of 100 pertains to each string in FIG. 12*a*, it is 80 for each string in FIG. 12*b*. That is to say, although the frequency spectrum picked up has been altered, the volume picked up per string in FIG. 12*b* is mutually still the same, though less than in the situation of FIG. 12*a*. With the present device it is therefore possible to achieve the result that the volume and frequency spectrum picked up for each string can be regulated mutually independently in a purely mechanical manner. The strings 1*a*, 1*b*, 1*c* in FIGS. 12*a* and 12*b* are wrapped strings from which the sound picked up in accordance with the situation of FIG. 12*b* is "thinner" than that of FIG. 12*a*. Strings 1*d*, 1*e*, 1*f* are unwrapped strings from which the sound picked up in accordance with FIG. 12*b* is "richer" than that according to FIG. 12*a*. Of course, the percentages given in FIGS. 12*a* and 12*b* are stated only by way of example. Other percentages are also possible within the scope of the invention.

I claim:

1. A pick-up element in a stringed instrument for converting a vibration generated in at least one string into an electrical signal, comprising a pick-up section underneath each string, which pick-up section comprises at least three magnetic poles, each magnetic pole exerting a magnetic force on the respective string, the magnetic poles being placed in a row underneath the string, which row extends substantially parallel to the respective string, at least one of the poles comprising a first bolt which can be moved in a direction substantially perpendicular to the string and the magnetic poles deriving their magnetic action from permanent magnets positioned between the poles, wherein the permanent magnets are separated from the pole not situated at the outside of the pick-up section by nonmagnetic means.

2. A pick-up element according to claim 1, wherein at least one second pole of each pick-up section comprises a second bolt which can be moved in the direction of the string.

3. A pick-element according to claim 1, wherein each pick-up section comprises three poles which each comprise one bolt.

4. A pick-up element according to claims 1, wherein one or more of the bolts are socket-head bolts.

5. A pick-up element according to claim 1, wherein the magnets are RES ("rare earth sintered") magnets.

6. A pick-up element according to claim 1, wherein the poles which do not comprise bolts are made of Stanley knife material.

7. A pick-up element according to claim 1, wherein the nonmagnetic means comprise a cavity filled with air.

8. A pick-up element according to claim 1, wherein the nonmagnetic means are nonmagnetic separating elements.

9. A pick-up element according to claim 1, wherein said element comprises more rows of pick-up sections next to one another than the number of strings present.

10. A pick-up element according to claim 1, wherein at least the bolt of the pole not situated at the outside of the pick-up section can be screwed so deeply into the pick-up element that the top face of the bolt is located, in the screwed-in state, at the level of that side of the permanent magnet which is nearest the strings.

11. A pick-up element in a stringed instrument for converting a vibration generated in at least one string into an electrical signal, comprising:

a pick-up section underneath each string, wherein each said pick-up section comprises at least three magnetic poles, and each magnetic pole exerts a magnetic force on the respective string which it underlies, said respective magnetic poles of each said pick up section being aligned in a row underneath and substantially parallel to the respective string;

each said pick-up section further comprising permanent magnets positioned between said poles, and nonmagnetic means for separating said permanent magnets from at least one said pole not situated at the outside of said pick-up section;

wherein at least one of said poles of each said pick-up section comprises a first bolt which is movable toward and away from the respective string under which said first bolt lies.

* * * * *

UNITED STATES PATENT AND TRADEMARK OFFICE

CERTIFICATE OF CORRECTION

PATENT NO. : 5,354,949

DATED : October 11, 1994

INVENTOR(S) : Erno ZWAAN

It is certified that error appears in the above-indentified patent and that said Letters Patent is hereby corrected as shown below:

At column 1, line 51, change "centre" to ---center---.
At column 3, line 13, change "mother" to ---another---.
At column 3, line 49, change "centre" to ---center---.
At column 5, line 4, change "mope" to ---more---.
At column 5, line 24, change "i" to ---1---.
At column 5, line 32, change "oF" to ---or---.
At column 6, line 7, change "if" to ---1f---.
At column 6, line 15, change "12a" to ---12b---.
At column 6, line 62 (claim 3, line 1), change "pick-element" to ---pick-up element---.
At column 6, line 65 (claim 4, line 1), change "claims" to ---claim---.
At column 8, line 9 (claim 11, line 9), change "pick up" to ---pick-up---.

Signed and Sealed this

Twelfth Day of September, 1995

*Attest:*

*Attesting Officer*

BRUCE LEHMAN

*Commissioner of Patents and Trademarks*